United States Patent [19]

Piber

[11] 4,321,443

[45] Mar. 23, 1982

[54] LIGHTED TOGGLE LEVER SWITCH HAVING ARTICULATED CONDUCTORS

[75] Inventor: Earl T. Piber, Oconomowoc, Wis.

[73] Assignee: Eaton Corporation, Cleveland, Ohio

[21] Appl. No.: 181,013

[22] Filed: Aug. 25, 1980

[51] Int. Cl.[3] ..... H01H 9/16

[52] U.S. Cl. ..... 200/315; 200/276; 200/296; 200/302; 200/339

[58] Field of Search ..... 200/276, 296, 302, 310–317, 200/339; 116/248

[56] References Cited

U.S. PATENT DOCUMENTS

| | | | |
|---|---|---|---|
| 2,252,489 | 8/1941 | Bluemle | 200/316 |
| 2,846,548 | 8/1958 | Christenson | 200/338 |
| 3,301,988 | 1/1967 | Weitzman | 200/315 |
| 3,350,521 | 10/1967 | Brown . | |
| 3,409,751 | 11/1968 | Kreiger | 200/315 |
| 3,437,775 | 4/1969 | Piber | 200/314 |
| 3,614,362 | 10/1971 | Keranen | 200/315 |
| 3,711,669 | 1/1973 | Keranen | 200/315 |
| 4,013,856 | 3/1977 | Joss et al. | 200/314 |
| 4,055,739 | 10/1977 | Piber | 200/315 |
| 4,172,973 | 10/1979 | Sand | 200/315 |

FOREIGN PATENT DOCUMENTS

| | | | |
|---|---|---|---|
| 624508 | 6/1949 | United Kingdom | 200/315 |

*Primary Examiner*—Stephen Marcus

*Attorney, Agent, or Firm*—C. H. Grace; W. A. Autio

[57] ABSTRACT

A lighted toggle lever switch having a pair of like insulator halves (14, 16) with short trunnions (14*a*, 16*a*) that pivot a toggle lever (8) at opposite ends of a lateral hole 10*b* therethrough, these insulator halves lining the metal cover (4) and bushing (6) and each having a channel (14*j*, 14*k*) for a lamp terminal. Coaxial helical spring connectors (20, 22) separated by an insulating tube (26) electrically connect the terminals to a lamp bulb (18) within the hollow toggle lever handle that has a threaded-in lens cap (12) at its external end.

10 Claims, 5 Drawing Figures

LIGHTED TOGGLE LEVER SWITCH HAVING ARTICULATED CONDUCTORS

BACKGROUND OF THE INVENTION

Lighted toggle lever switches have been known heretofore. For example, J. J. Keranen U.S. Pat. No. 3,614,362, dated Oct. 19, 1971, shows such a switch having a lamp bulb within the hollow toggle lever, molded plastic ball-and-socket structure for pivoting the toggle lever in the bushing, and a pair of lateral helical compression springs extending from recesses in the toggle lever ball on its pivotal axis and contacting terminals extending up within opposite sides of the bushing. Also, E. T. Piber U.S. Pat. No. 4,055,739, dated Oct. 25, 1977, shows such a switch having a light emitting diode within the hollow toggle lever, molded plastic ball-and-socket structure for pivoting the toggle lever in the bushing, and right-angle bends on the two LED terminals so as to be biased outwardly into contact with the upper ends of a respective pair of inwardly-biased terminals mounted in the bushing. In both of these patents, current is conducted from stationary terminals in the switch housing, or bushing, to the movable light indicator within the pivotal toggle lever.

While these prior switch structures have been useful for their intended purposes, this invention relates to improvements thereover.

SUMMARY OF THE INVENTION

An object of the invention is to provide a metal bushing type electric switch with improved means for conducting electric current from stationary terminals in its housing to a movable light indicator within its pivoted operating lever.

A more specific object of the invention is to provide a lighted toggle lever switch with improved pivotal lever structure accommodating articulated electrical connector means.

Another specific object of the invention is to provide a lighted pivotal actuator switch with improved means conducting current from stationary terminals to an indicator in the movable actuator without impeding actuation of the latter.

Another specific object of the invention is to provide a toggle switch with bushing structure that is especially adapted for accommodating articulated connectors for an indicator light within the lever handle.

Another specific object of the invention is to provide a lighted toggle lever switch with improved lever pivoting bushing structure that is economical to manufacture and easy to assemble.

Other objects and advantages of the invention will hereinafter appear.

DESCRIPTION OF THE PREFERRED EMBODIMENT

Figure 1:
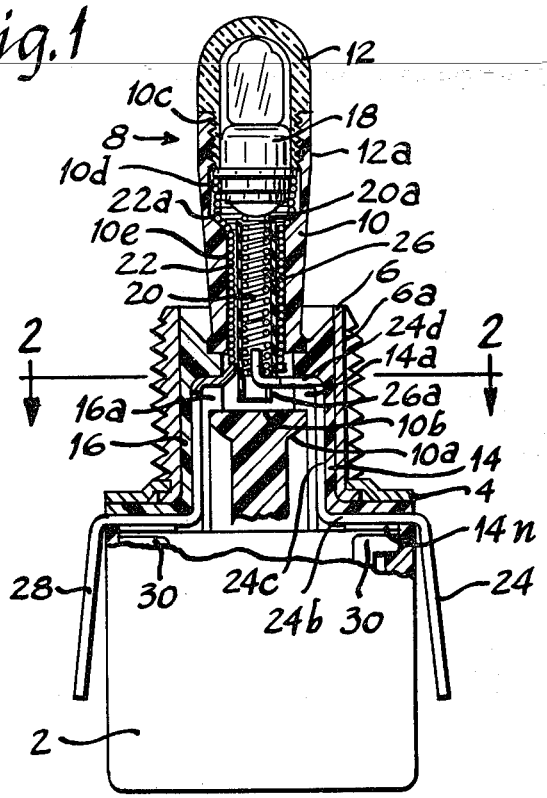
FIG. 1 is a partly lateral cross-sectional and partly elevational view of a lighted toggle lever switch showing the bushing insulator structure and articulated conductors.
Figure 2:
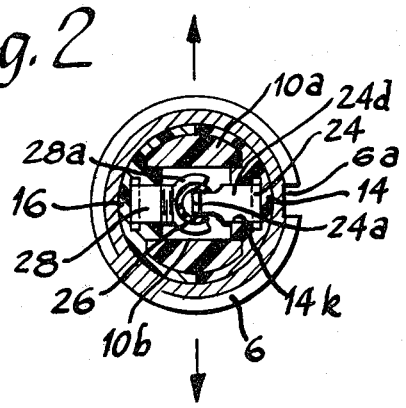
FIG. 2 is a horizontal cross-sectional view taken through the bushing substantially along line 2—2 of FIG. 1 to show the upper end configurations of the lamp terminals.

Referring to FIGS. 1 and 2, there is shown a lighted toggle lever switch having articulated conductors and constructed in accordance with the invention. As shown therein, this switch is provided with a housing comprising a molded insulating base 2 and a metal cover 4 having a relatively large hole at its center to which an externally-threaded bushing 6 is attached, such bushing being made of metal such as brass or the like.

While base 2 is shown only schematically, this base and the switch contacts therein are known in the art and reference may be had to A. W. Krieger U.S. Pat. No. 1,998,962, dated Apr. 23, 1935, for an illustration and description thereof. A base of this type may house single-throw bridging contacts that close when the toggle lever is actuated in one direction and re-open when the toggle lever is swung back in the other direction as shown in the above Krieger patent but other types are possible. A base of this type also has a pair of vertical holes through which rivets or bolts extend to mount the cover thereto as hereinafter more fully described.

Cover 4 is a generally rectangular metal plate having a round hole at its center with the edge of the plate around this hole being slightly formed upwardly to provide enough space for the lower end of bushing 6 to be flared thereunder when the bushing is secured to the plate and with the flared end of this bushing being substantially flush with the lower surface plane of the plate. Thus, the rim of the hole in this cover will be pinched between the lower flared end and the thicker-wall, threaded portion of this bushing rigidly to secure the bushing to the cover plate.

Bushing 6 is externally threaded so that it can be pushed through a round hole in a mounting panel and a nut turned thereon to mount the switch to the panel. Such hole in the panel would have a key in one side thereof that enters a keyway 6*a* shown in FIG. 1 to keep the switch from turning when in use.

The switch is actuated by a pivotal operating member such as a toggle lever 8. As shown in FIG. 1, this toggle lever is pivotally supported within the bushing at substantially its mid-portion, has an external handle portion at one end that is grasped by the user to actuate the switch, and has an innr contact-operating portion at its other end that moves the contacts between open and closed positions as the handle portion is manipulatedin the usual manner for a switch of the toggle lever type.

This toggle lever comprises a main lever 10 and a lens or cap 12 secured to its external end. This main lever is provided with pivot means comprising an enlarged, generally spherical or convex mid-portion 10*a* that is in close association with a contiguous concave bore within the bushing as shown in FIG. 2 to close the bushing as well as possible against entry of dirt or the like. This main lever pivot means also comprises a lateral hole 10*b* through this enlarged portion of the lever for accommodating pivoting trunnions 14*a* and 16*a* of a pair of bushing liner or insulator halves 14 and 16 as shown in FIG. 1. As shown therein, these trunnions extend into opposite ends of this lateral hole 10*b* in the main lever to pivot the lever for limited pivotal movement in the bushing.

This main lever is also provided with means for supporting an indicator lamp 18 in its external handle portion. This means comprises a hollow section extending from lateral hole 10*b* all the way through the external portion of main lever 10. This hollow section comprises a hole 10*c* of uniform cross-section extending up from lateral hole 10*b* for retaining concentric connectors 20 and 22 which hole then flares out to a larger diameter 10*d* for retaining the base of lamp 18 as well as the upper end 20*a* of inner connector 20 and the enlarged diameter upper end 22*a* of outer concentric connector 22. The extreme upper end portion of such larger diameter hole is provided with internal threads 10*e* for retaining the externally-threaded lower end 12*a* of lens 12 that covers the lamp bulb. While main lever 10 is a plastic molded member made of nylon or the like, cap 12 is a plastic molded member of polystyrene or the like that may be transparent or translucent to transmit the light from the lamp bulb as an indication of switch operation or the like. On the other hand, this lens cap 12 may be colored such as red or green, for example, while still conducting sufficient light to give an indication.

Inner connector 20 is a helical spring of uniform diameter that contacts at its upper end the center contact of the base of lamp bulb 18 and contacts at its lower end the internal end of terminal 24. This inner helical spring is compressed between terminal 24 and the lamp bulb sufficiently to provide the necessary contact pressure for a good electrical connection. This inner helical spring is surrounded by an insulator tube 26 having a notch 26*a* at its lower end to provide access for the narrow tip of terminal 24 while providing insulation the rest of the way around to prevent contact with either terminal 28 or helical spring 22.

As shown in FIG. 1, outer helical spring connector 22 surrounds insulator tube 26 within the hole or bore 10*c*. The upper enlarged-diameter end of this spring 22 contacts the concentric outer contact of the lamp bulb while the lower end of this spring contacts terminal 28. This spring 22 also is in sufficient compression to provide the necessary contact pressure for a good electrical connection. Terminals 24 and 28 may be made of brass or the like for good electrical conductivity.

As shown in FIG. 2, terminal 24 has a narrow tip 24*a* that is bent up so that it extends up into the lower end of inner helical spring connector 20 as shown in FIG. 1 and makes contact therewith. As shown in FIG. 2, terminal 28 has a partial-circular tip 28*a* so as to surround tip 24*a* about two-thirds of the way around and in spaced relation thereto, thus providing a contacting seat for outer helical spring connector 22. This partial-circular terminal tip 28*a* has an inner diameter large enough to allow the lower end of insulator tube 26 to extend freely therethrough so that notch 26*a* rests on terminal 24. Connector springs 20 and 22 are made of metal such as phosphor bronze or the like so as to provide good electrical conduction and maintain contact bias between the two terminals and the lamp bulb. Insulator tube 26 may be made of electrical grade fibre or the like to afford effective electrical insulation between the parts.

This switch is also provided with means for performing a number of desirable functions or results, among which are: providing mounting means for lamp terminals 24 and 28 while concurrently insulating these terminals from the metal cover and bushing, supporting these terminals in such a way as to adapt the toggle lever for retaining articulated connectors between these terminals and the indicator lamp, and providing pivoting means for the toggle lever such that the articulated connectors will not impede pivotal actuation of the toggle lever while concurrently keeping the bushing closed to prevent entry of dirt into the switch housing. These are accomplished by two like molded parts hereinafter described.

Figure 3:
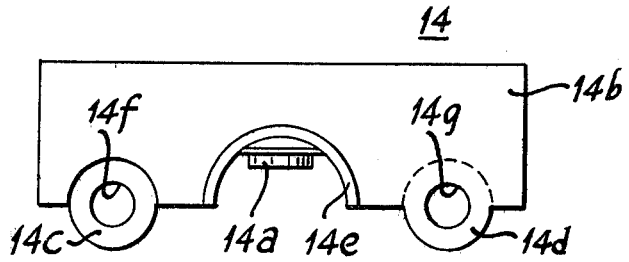
FIG. 3 is a top view of one of the two like bushing insulator halves used in the switch of FIGS. 1 and 2 and showing the integral trunnion and the mounting holes thereon.
Figure 4:
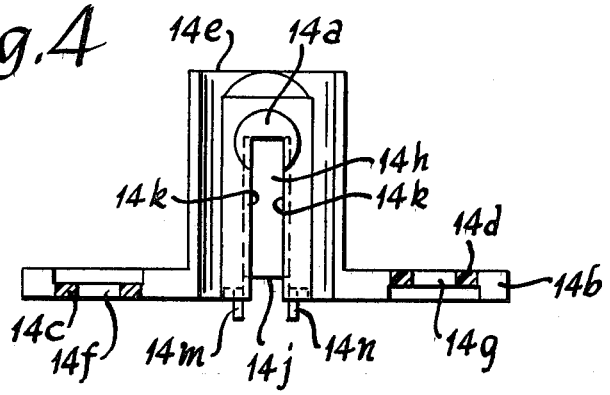
FIG. 4 is an elevational view of the bushing insulator half of FIG. 3 showing its joining surface configuration, the integral trunnion, bushing bore and channel for accommodating one of the lamp terminals.
Figure 5:
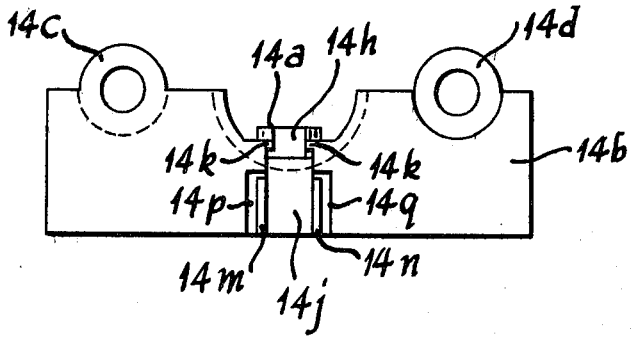
FIG. 5 is a bottom view of the bushing insulator half of FIGS. 3 and 4 showing the horizontal portion of the channel for accommodating one of the lamp terminals.

This lamp terminal retaining and toggle lever pivoting means comprises a pair of like bushing insulator halves 14 and 16, one of which, 14, is shown in FIGS. 3–5. This insulator half is a plastic molded member of nylon or the like and comprises a generally flat cover plate portion 14*b* having two half-circle tabs 14*c* and 14*d* near the opposite ends of the longitudinal joining edge thereof with a half-bushing liner 14*e* extending up therebetween. As shown in FIG. 4, tabs 14*c* and 14*d* are in the planes of the lower one-half and the upper one-half of the thickness of plate portion 14*b*, respectively, so as to provide inter-fitting engagement when insulator halves 14 and 16 are put together and inserted into the metal bushing of the switch. These tabs 14*c* and 14*d* are also perforated in line with the joining edge of plate portion 14*b* to provide rivet holes 14*f* and 14*g* superimposed under and over the respective holes of insulator half 16 when the two insulator halves are brought together. The remainder of the abutting surfaces of the insulator halves are flat or complementary to one another to make a tight joint when the parts are assembled. As aforementioned, insulator half 14 is provided with a short trunnion 14*a* that enters one end of the lateral hole in the enlarged spherical portion of the toggle lever for pivotally supporting the latter. As shown in FIG. 4, insulator half 14 is also provided with a vertical channel 14*h* within its bushing liner 14*e* which joins at its lower end a horizontal channel 14*j* extending to the outer edge of plate portion 14*b* for accommodating terminal 24. As shown in FIGS. 4 and 5, vertical channel 14*h* has narrow vertical lips 14*k* at opposite sides behind which vertical portion 24 of the terminal is slid upwardly to confine the terminal therein and prevent it from tipping toward the other terminal when spring 20 is placed in compression by assembly of the lamp bulb and cap. To fit this channel, the external portion of terminal 24 as well as the adjoining horizontal portion 24*b* and the next adjoining vertical portion 24*c* are of equal width to fit channels 14*h* and 14*j*. Also, chanel 14*h* extends up to the center of trunnion 14*a* for non-impeding toggle lever actuation purposes. The next adjoining horizontal portion 24*d* of the terminal is narrower so that it can emerge between lips 14*k* as shown in FIG. 2 and extend into the center of the lateral hole in the toggle lever. The horizontal portion 24*d* then narrows again into tip 24*a* before it turns up into the center of connector spring 20 as shown in FIG. 2. Insulator half 14 is further provided with two tabs 14*m* and 14*n* shown in FIGS. 4 and 5 extending down from opposite sides of horizontal channel 14*j* that are heat-formed toward one another below horizontal portion 24*b* of the terminal as shown in FIG. 1. To facilitate this forming operation, grooves 14*p* and 14*q*, shown in FIG. 5, are provided in the bottom of cover plate portion 14*b* around the outside of tabs 14*m* and 14*n* so that these tabs can readily be formed below terminal 24 flush with or above the lower surface of cover plate portion 14*b*.

In this manner, insulator half 14 locks terminal 24 in place so that it does not slip out of place when the remainder of the switch is assembled.

As partly shown in FIG. 1, the side lugs 30 of a generally U-shaped bridging contactor are pivotally supported in notches at the center-top of opposite side walls of the base. Since the lamp terminals overlie these notches, a secondary function of the formed-over tabs 14*m* and 14*n* is to insulate the lamp terminals from the bridging contactor.

From the foregoing, it will be apparent that the switch can be assembled by first inserting the lamp terminals up into the channels in the insulator halves and forming the tabs over to lock them in place. The trunnions of the insulator halves are next inserted into the opposite ends of the lateral hole in the main toggle lever as the insulator halves are straddled around the toggle lever. With the joining surfaces of these insulator halves held together and the lever therebetween, this subassembly is then inserted up into the metal bushing-cover subassembly such that the cover plate portions of the insulator halves abut the metal plate and the rivet holes in both are superimposed. This subassembly is then placed over the switch base having the contacts preassembled therein and the cover is riveted to the base. The outer helical spring connector is next dropped down into the hole in the lever, followed by the insulator tube and the inner helical spring connector, making sure that the notch on the insulator tube falls over the tip of the inner terminal. The lamp bulb is then placed into the cap, these two being so dimensioned that the lamp bulb is self-retaining therein by friction or the like. Finally, the lamp cap is threaded into the external end of the lever to complete the assembly.

In operation, when the toggle lever is actuated in either direction as indicated by the arrows in FIG. 2, connector springs 20 and 22 will flex near their lower ends while remaining seated on and in good electrical contact with tips 24*a* and 28*a* of the lamp terminals due to these connector springs being in compression between the lamp bulb and the lamp terminals. However, this compression is not so much as to close the spring turns but to leave them open. Thus, these connector springs impose negligible resistance to the free movement of the toggle lever as it pivots on the trunnions of the straddling insulator halves held in the bushing while maintaining a good electrical connection to the lamp bulb.

From the foregoing, it will be apparent that the invention provides a metal bushing type lighted toggle lever switch that is simple in construction and uses a minimum number of parts and is easy to assemble. For example, this construction eliminates the need for an insulating plate between the base and the cover as well as the toggle lever pivot pin used in prior switches such as that shown in the aforementioned Krieger patent. Moreover, this construction also solves the problem of mounting, insulating, and articulating the connectors between the switch housing and the lamp bulb in the tip of the toggle lever in a metal bushing switch.

While the apparatus hereinbefore described is effectively adapted to fulfill the objects stated, it is to be understood that the invention is not intended to be confined to the particular preferred embodiment of lighted toggle lever switch having articulated conductors disclosed, inasmuch as it is susceptible of various modifications without departing from the scope of the appended claims.

I claim:

1. In a switch having a housing including a base enclosing contacts and a cover over said base with a bushing extending up from said cover, the combination comprising:

a toggle lever extending through said bushing and having an internal lower end portion for actuating said contacts and an external upper end portion for manual operation by the user;

means pivotally supporting said toggle lever in said bushing comprising;

a lateral hole through the middle portion of said toggle lever; and a pair of insulating cover and bushing liner halves straddling said toggle lever and each having a trunnion extending into the corresponding end of said lateral hole to pivot said toggle lever thereon;

said combination also comprising:

a light source in the external end of said toggle lever;

a longitudinal hole extending from said lateral hole to said light source;

and articulated electrical connection means from said light source through said longitudinal hole, said lateral hole, said trunnions and said insulating liner halves to external terminal portions.

2. The combination claimed in claim 1, wherein:

each said insulating cover and bushing liner half has an inner channel therein;

and said electrical connection means comprises:

a pair of lamp terminals, each extending from its external terminal portion on the outside of the switch housing through the channel in its corresponding liner half and along the center axis of its trunnion and said lateral hole to a tip at the lower end portion of said longitudinal hole in said toggle lever;

and a pair of resilient connectors extending through said longitudinal hole between said terminal tips and said light source.

3. The combination claimed in claim 2, wherein:

said terminal tips include a narrow tip on one terminal upstanding at the center of said longitudinal hole and a partial-circular tip on the other terminal coaxially around and spaced from said narrow tip;

said connectors comprise a pair of coaxial helical springs between said tips and said light source;

and an insulating tube between said coaxial helical springs.

4. The combination claimed in claim 1, wherein:

each said insulating cover and bushing liner half has a terminal-retaining channel therein;

said channel extending from the outside edge of the cover liner portion of said liner half along the bottom of the latter and vertically along the inside of the bushing liner portion thereof and then inwardly along the lower half of the trunnion thereof;

and said connection means comprises a terminal in said channel extending from said external terminal portion to the center of said toggle lever.

5. The combination claimed in claim 4, wherein:

the vertical portion of said channel that extends along the inside of said bushing liner portion has a pair of lips on the vertical sides thereof;

and said terminal has a narrowed inwardly-extending portion fitting between said lips to enable the wider vertical portion of said terminal to be slid up from the bottom behind said lips into said channel.

6. The combination claimed in claim 5, wherein:

said cover liner portion has a pair of integral tabs on opposite sides of said channel that may be formed toward one another below said terminal after the latter has been inserted into its channel to lock said terminal in place.

7. The combination claimed in claim 1, wherein:

said cover and bushing liner halves are alike and have complementary half-thickness perforated half-circle tabs extending from the joining edges of their cover liner portions through which rivets extend when the cover and base are riveted together.

8. The combination claimed in claim 1, wherein:

said toggle lever has an enlarged generally spherical middle portion through which said lateral hole extends that is in close contact with the inner surfaces of said bushing liner portions to exclude dirt from said switch housing.

9. In a switch having an insulating open-top base enclosing switch contacts, and a metal cover having a hole from the rim of which a metal bushing extends upwardly, and a toggle lever having an external handle portion and extending through said bushing for actuating said switch contacts, the improvement comprising:

toggle lever pivoting means comprising:

a pair of complementary insulating members embracing said toggle lever within said bushing and underlying said metal cover and having opposed trunnions extending freely into opposite ends of a round hole through said toggle to pivotally support the latter in said busing;

said handle portion being hollow and having a lamp bulb in the external end thereof;

conductor channels in the bottoms and embracing portions and trunnions of said insulating members;

lamp terminals extending from the outside through said channels into said hollow handle portion so as to be insulated from said metal cover and bushing;

and coaxial insulated resilient connectors between the respective inner ends of said terminals and the contacts of said lamp bulb within said hollow handle portion.

10. The improvement claimed in claim 9, wherein:

said connectors are concentric helical springs separated by an insulating tube and being in sufficient compression to make good electrical contact to said lamp bulb and said terminals.

* * * * *